US010378239B2

(12) United States Patent
Avganim

(10) Patent No.: US 10,378,239 B2
(45) Date of Patent: Aug. 13, 2019

(54) SMART LOCK

(71) Applicant: Meir Avganim, Gealya (IL)

(72) Inventor: Meir Avganim, Gealya (IL)

( * ) Notice: Subject to any disclaimer, the term of this patent is extended or adjusted under 35 U.S.C. 154(b) by 713 days.

(21) Appl. No.: 14/267,064

(22) Filed: May 1, 2014

(65) Prior Publication Data

US 2014/0326027 A1 Nov. 6, 2014

Related U.S. Application Data

(60) Provisional application No. 61/819,912, filed on May 3, 2013.

(51) Int. Cl.

| | |
|---|---|
| ***E05B 47/00*** | (2006.01) |
| ***E05B 73/00*** | (2006.01) |
| ***G07C 9/00*** | (2006.01) |
| *E05B 63/12* | (2006.01) |

(52) U.S. Cl.

CPC ..... *E05B 47/00* (2013.01); *E05B 73/0082* (2013.01); *G07C 9/00174* (2013.01); *E05B 47/0012* (2013.01); *E05B 63/127* (2013.01); *E05B 2047/0058* (2013.01); *E05B 2047/0095* (2013.01); *G07C 9/0069* (2013.01); *G07C 2009/00761* (2013.01); *G07C 2009/00769* (2013.01); *Y10T 70/7051* (2015.04)

(58) Field of Classification Search

CPC ..... E05B 2047/0095; E05B 73/0082; E05B 73/00; E05B 2047/0058; E05B 2047/0094; E05B 39/04; E05B 47/00; E05B 47/0012; E05B 63/127; Y10T 70/7051; G07C 9/0069; G07C 2009/00761; G07C 2009/00769

USPC ..... 70/14, 57, 58, 277, 278.1, 278.7, 257; 340/5.53, 5.7

See application file for complete search history.

(56) References Cited

U.S. PATENT DOCUMENTS

| | | | | |
|---|---|---|---|---|
| 5,566,012 | A * | 10/1996 | Koshimizu et al. | 349/116 |
| 5,854,736 | A * | 12/1998 | Fuhs et al. | 361/679.57 |
| 5,936,544 | A | 8/1999 | Gonzales et al. | |
| 6,047,575 | A * | 4/2000 | Larson et al. | 70/278.1 |
| 6,449,992 | B1 * | 9/2002 | Yu et al. | 70/58 |
| 6,487,884 | B1 | 12/2002 | Constantinou | |
| 6,971,255 | B2 * | 12/2005 | Bhogal et al. | 70/58 |
| 8,230,707 | B2 * | 7/2012 | Hung et al. | 70/58 |
| 8,353,187 | B2 * | 1/2013 | Woodling | 70/278.7 |
| 8,453,481 | B2 * | 6/2013 | Meekma | 70/38 A |
| 8,534,101 | B2 * | 9/2013 | Mette et al. | 70/277 |
| 8,805,434 | B2 * | 8/2014 | Vasudevan | 455/550.1 |
| 8,847,732 | B2 * | 9/2014 | Schroter | 340/5.82 |
| 8,922,333 | B1 * | 12/2014 | Kirkjan | 340/5.1 |
| 9,013,271 | B2 * | 4/2015 | Aoki | 340/5.82 |

(Continued)

OTHER PUBLICATIONS

International Search Report and Written Opinion issued by the IPEA/EP Patent Office dated Sep. 11, 2014 in connection with corresponding application PCT/US 2014/036331.

(Continued)

*Primary Examiner* — Suzanne L Barrett
(74) *Attorney, Agent, or Firm* — Ostrolenk Faber LLP

(57) ABSTRACT

Locking devices and, more particularly, locks that are electronically operable and controllable by mobile devices such as telephones, PCs, tablets and the like, include a lock body with a slider that actuates the lock into a locked state and software in the mobile device that operates the lock to an unlocked state.

23 Claims, 15 Drawing Sheets

(56) References Cited

U.S. PATENT DOCUMENTS

| | | | | |
|---|---|---|---|---|
| 2004/0168486 | A1* | 9/2004 | Ling | 70/58 |
| 2005/0039502 | A1* | 2/2005 | Avganim | 70/58 |
| 2005/0231365 | A1* | 10/2005 | Tester et al. | 340/568.1 |
| 2006/0081021 | A1* | 4/2006 | Merrem et al. | 70/58 |
| 2006/0107073 | A1* | 5/2006 | Lane et al. | 713/194 |
| 2006/0283216 | A1* | 12/2006 | Marcelle et al. | 70/38 A |
| 2007/0144225 | A1* | 6/2007 | Tamura | 70/58 |
| 2007/0169523 | A1* | 7/2007 | Lu | 70/58 |
| 2007/0290790 | A1 | 12/2007 | Miller et al. | |
| 2008/0034816 | A1* | 2/2008 | Lu | 70/58 |
| 2008/0309451 | A1* | 12/2008 | Zellweger et al. | 340/3.32 |
| 2011/0273852 | A1* | 11/2011 | Debrody et al. | 361/747 |
| 2011/0289986 | A1* | 12/2011 | Zhai et al. | 70/58 |
| 2012/0129493 | A1* | 5/2012 | Vasudevan | 455/411 |
| 2013/0180295 | A1* | 7/2013 | Avganim | 70/58 |
| 2013/0183924 | A1* | 7/2013 | Saigh et al. | 455/404.2 |
| 2014/0069153 | A1* | 3/2014 | Wu et al. | 70/58 |
| 2014/0085788 | A1* | 3/2014 | Avganim | 361/679.01 |
| 2014/0150502 | A1* | 6/2014 | Duncan | 70/20 |
| 2014/0250954 | A1* | 9/2014 | Buzhardt | 70/20 |
| 2014/0360232 | A1* | 12/2014 | Al-Kahwati et al. | 70/14 |
| 2015/0007619 | A1* | 1/2015 | Finney et al. | 70/58 |
| 2015/0027178 | A1* | 1/2015 | Scalisi | 70/277 |

OTHER PUBLICATIONS

International Preliminary Report on Patentability (IPRP) issued by the IPEA/EP Patent Office dated Nov. 12, 2015 in connection with corresponding application PCT/US2014/036331.

* cited by examiner

SMART LOCK

CROSS-REFERENCE TO RELATED APPLICATION

This application claims benefit of and priority to U.S. Provisional Application Ser. No. 61/819,912 filed May 3, 2013, the contents of which are incorporated herein by reference.

BACKGROUND OF THE INVENTION

The present invention is generally directed to locking devices and, more particularly, to locks that are electronically operable and controllable by mobile devices such as telephones, PCs, tablets and the like.

One of the disadvantages of conventional locks is that people must carry in their pockets or bags many different physical keys to accommodate the different locks or memorizing many different combination codes that can be easily forgotten and sometimes compromised.

Another disadvantage of conventional locks concerns the subject of miniature locks that are required to lock modern mobile devices such as laptops, tablets, telephones and the like which typically lock inside a 3×7 mm locking slot into which a miniature locking element is inserted. These locks must shrink beyond their present size to accommodate the shrinking thicknesses of mobile devices. These thicknesses make it very difficult to make a lock body which is thin enough and yet capable of accommodating bulky keys or locking combination wheels.

Accordingly, it is desirable to provide various locks for different applications that can be referred to as "smart locks" which can be opened and closed via mobile devices, such as telephones, cell devices, small PCs, tablets and the like.

SUMMARY OF THE INVENTION

It is an object of the present invention to provide an electronically operable and controllable locking device.

It is a further object of the present invention to provide lock configurations for different applications that can be opened and locked via mobile devices such as telephones, cellular devices, tablets and the like.

The foregoing and other aspects of the invention are realized with a locking system comprising: a lock body including a locking element, a moving mechanism coupled to and configured to operate the locking element, an electrical controller configured to control the moving mechanism, the lock body further comprising a facility for receiving electrical commands for the electrical controller. A separate mobile electronic device for providing the electrical commands to direct the electrical controller to at least control the moving mechanism to move the locking element into an open position is included. In accordance with other embodiments, the mobile device communicates through a USB port via a direct connection utilizing physical connectors. However, the connection can be wireless. Also, the mobile electronic device may be a telephone, tablet or a specially designed mobile device which is incorporated into a wristwatch or which can be clipped or otherwise attached to a watch band and worn on a person's wrist all day long for easy and ready availability.

Other features and advantages of the present invention will become apparent from the following description of the invention which refers to the accompanying drawings.

DETAILED DESCRIPTION OF EMBODIMENTS OF THE INVENTION

Figure 1:
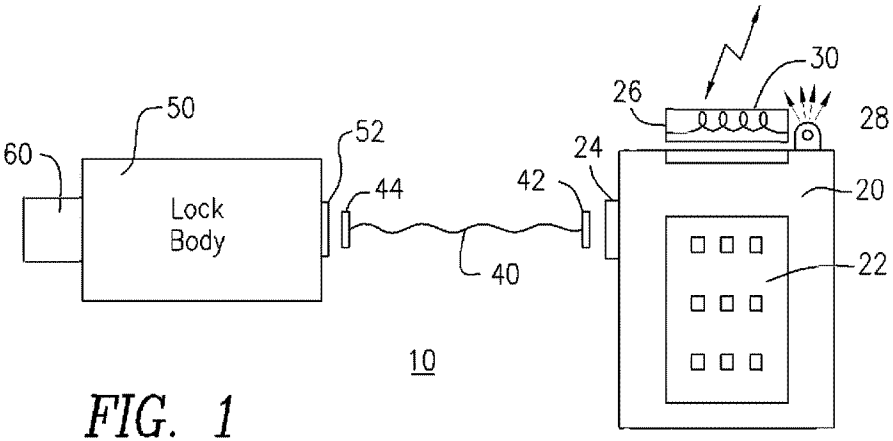
FIG. 1 is a system diagram of the lock and a corresponding smart mobile device that operates it.

Referring to FIG. 1, the locking system 10 of the present invention has as its main components, a lock operating device 20, typically a cell phone, a small PC or a mobile tablet, that comprises the typical glass screen or keyboard 22 and internal programs. The cell phone 20 has a connecting port 24 which may be a USB port, which can have attached to it a USB cable 40 with a first connector 42 that fits in USB port 24 and a second connector 44 that fits a corresponding connector 52 on a lock body 50. The lock body has a locking element 60 which may be a bolt that fits into a door jamb or it could be a rotatable device, such as a T-bar or the like, as shall be described below.

Figure 1A:
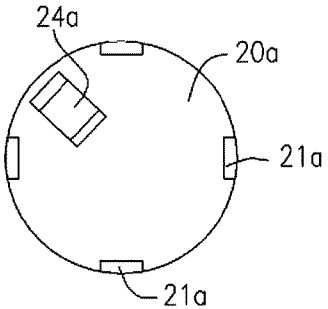
FIG. 1A shows the smart mobile device in the form of a wrist watch or in the form of a tiny electronic device which can be clipped or otherwise attached to the watch body or to the watch band.

Referring to FIG. 1A, the device 20 may be incorporated inside a watch body 20*a* which also incorporates a USB connector 24*a* which can be slid out or pivoted out in order to connect to the connector 52 on the lock body. Alternatively, the mobile device 20*a* may be clipped via snap clips or similar attachment pieces 21*a* to the underside of a watch. Still further, the outer shape may be rectangular enabling the device 20*a* to be clipped to a watchband. Preferably, the thickness of the device 20*a* is on the order of 2, 3 and preferably not more than 4 mm so that it can be easily worn and is readily accessible for operating the lock body 50.

The general concept provides for a software program embedded in a memory of the device 20 with a program algorithm for the lock body and a data connection through the cable 40 to the lock body 50. The lock body 30 houses a receiver, a lock ID code and a controller that selectably opens and closes the locking element 60, in response to commands entered via the device 20. The mechanism for opening and closing the locking element 60 may be an electromagnet, a small motor, a solenoid, or the like. The lock body 50 may have an internal power source, such as a battery, or, if located in an immovable home door, an A/C source (not shown). In certain configurations, power can be provided to the lock body 50 from the device 20. In operation, to open or lock the locking element 60, a suitable command or power signal is transmitted via the cable 40, after the user has first entered the required unique code for the particular lock.

In an alternate embodiment, the device 20 may operate the lock body 50 wirelessly, using near field technology. For example, the mobile device 20 may have a connector or device 26 that outputs an RF field for communicating with a corresponding connector 50 to unlock the lock body. Alternatively, the connector 26 houses a primary winding which delivers A/C power that charges an internal battery or a short term storage capacitor located inside the lock body 50 in order to temporarily power the lock body to enable changing the state (open or closed) of the locking element 60, as more fully described below.

In yet another embodiment, an intense light source 28 is provided on the mobile device 20 for outputting light which can quickly charge solar cells located inside the coupling connector 52 on the lock body to power up and control the locking element 60.

Figure 2:
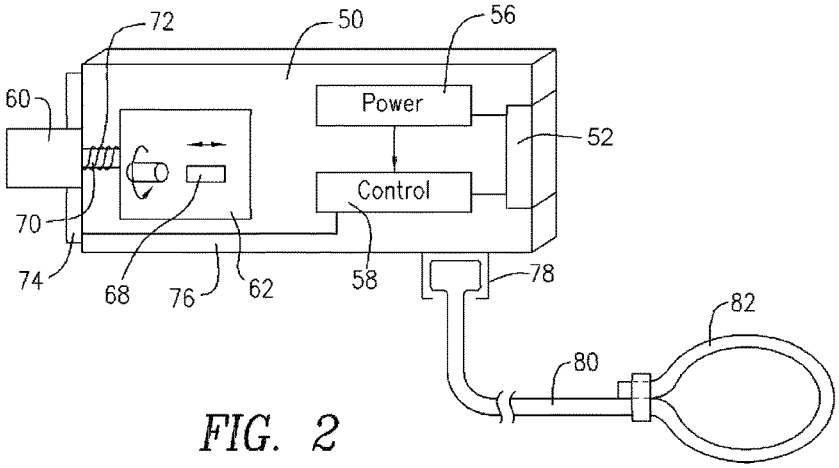
FIG. 2 is a diagram of internal components of the smart lock body.

Referring now to FIG. 2, the lock body 50 is shown in one embodiment thereof to have a generally flat and thin body construction, with a coupling connector 52 through which power may be supplied to an internal power storage device 56 that may be a battery or a capacitor that can hold power for an extended period, or even for a short period on the order of a minute or two sufficient to carry out the locking/unlocking operation. The power is then provided to a controller 58. The controller 58 can then power a lock element slider or rotator 62, which can either consist of a small, miniature motor 64 or a solenoid or electromagnet 68, either one of which is coupled to a shaft 70 which is directly coupled to the locking element 60.

The front face of the lock body 50 may be covered by a rotatable plate 74 which is inaccessible when the lock body is in a locked position, as when it is attached to the appliance or door with which it is used. However, when the lock body is in one's hand, the plate 74 may be moved to gain access via line 76 to an internal cavity which is accessible through the front of the lock, to rotate or press an element which resets the controller into a mode which allows programming of a new internal security code.

In the case of the familiar locking devices used with computer laptops, the body 50 has a flange 78, which holds the head of flexible cable 80 which terminates in an end loop 82. The size of the opening in the end loop allows the entire lock 50 to pass therethrough and so tether the lock body to a chair or desk or the like, so the computer laptop cannot be moved, thereby securing the laptop against theft.

Figure 3A:
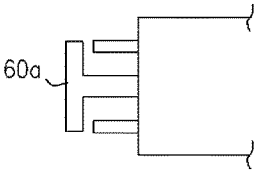
FIGS. 3A-3D show locking elements suitable for PC and computer applications that have standard slots.
Figure 3B:
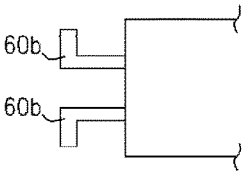
Figure 3C:
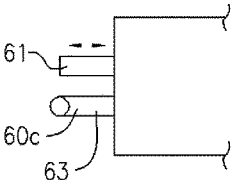
Figure 3D:
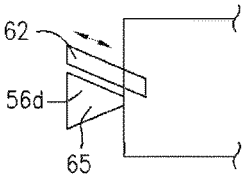

Referring now to FIGS. 3A-3D, it can be seen that the locking elements may be a conventional T-bar 60*a*, which is rotated inside a standard-sized 3×7 mm slot, as well known in the art. In FIG. 3B, a scissor action lock 60*b* is illustrated. In FIG. 3C, a T-bar 63 is first inserted into the standard slot and thereafter a pin 61 is slid into the same slot, preventing rotation of the T-bar 63. Lastly, FIG. 3D shows a novel trapezoidal style locking element with a first fixed element 65 and a slidable element 67, which operate together as described in the present inventor's pending application to fill a trapezoidal shaped locking slot.

Figure 4:
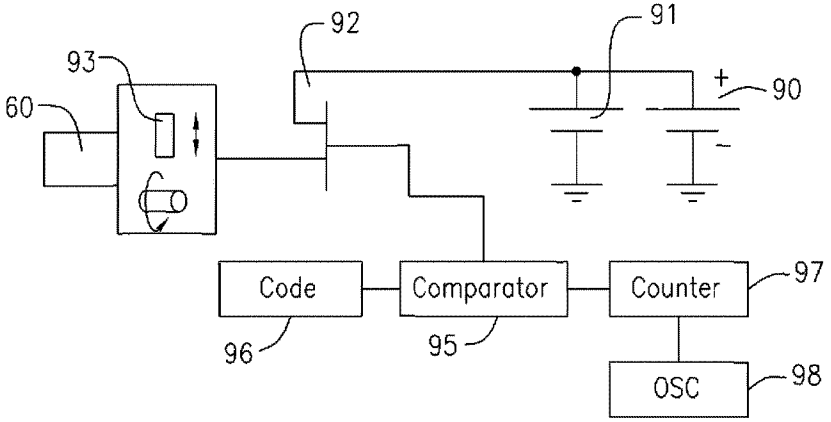
FIG. 4 shows an implementation of a controller for the smart lock of the present invention.

Referring now to FIG. 4, shown therein is a mechanism consisting of a rechargeable battery 90 which has a parallel capacitor 91 which provides a power input into one major node of a transistor 92, the other end of which is connected to the solenoid or motor 93 to operate the clock element. The gate 94 of the transistor 92 is connected to a comparator 95 which compares a pre-programmed code in a code storage device 96 on the one hand, to the count from a counter 97 which counts the pulses of an oscillator 98 when enabled by receiving a lock opening command from the lock controller 20 referred to previously.

Regardless, the code holding device 96 may be a non-volatile, electrically alterable device that can be programmed in a program mode as, for example, when the wire 76 (FIG. 2) is engaged.

In a typical operation, it is assumed that the lock body has been programmed with a particular code. In one embodiment, the locking element is configured to move into the locking position via a biasing spring 72, which will rotate or push the pin into the locking position. However, when the controlling device 20 receives the correct opening code, the locking device is turned or pulled to the open position until such time as one removes his or her fingers from an enabling button or icon on the mobile device 20. Alternatively, a single push of the controlling device on the mobile device opens the lock for a set period, for example, 10, 20, 30 or even 60 seconds, to allow sufficient time to open the door or remove a lock from the locking slot on a computer. The period during which the lock remains in the open mode may be programmable in a well-known manner, simply by having the right control program in the control module 58 inside the lock body and in the mobile device 20.

Figure 5A:
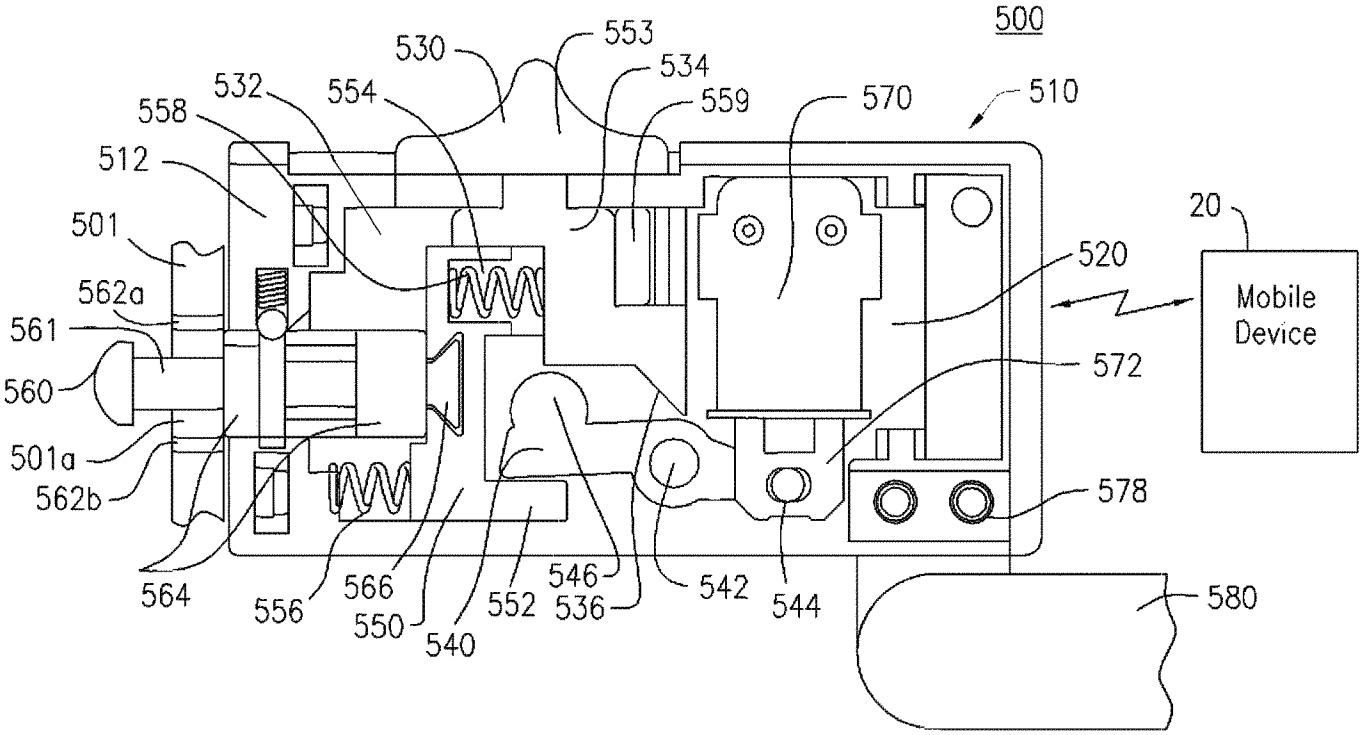
FIGS. 5*a* through 5*g* are diagrams showing an embodiment of the invention with a T-bar locking head.

Referring to FIGS. 5*a* through 5*g*, an embodiment of the invention in accordance with a detailed construction thereof is described below. In FIG. 5*a*, the locking system 500 comprises a rectangular locking body 510 and a mobile device 20. The locking body 510 is rectangular in shape with a length and width as shown in the Figure and with a thickness of just a few millimeters, on the order of 4 millimeters, for example, as previously described. At the left hand side in the Figure, is shown the conventional T-bar locking element 560, which has shaft 561 which protrudes through the wall 501 of a device to be protected by being pushed thereinto through a rectangular, for example, 3×7 mm, slot and with the T-bar 560 being rotated so that it cannot be pulled out.

For locking purposes, a pair of pins 562*a*, 562*b* are pushed into the security slot 501*a*, preventing separation of the lock body from the device to be protected, with lock body 510 being tethered via cable 580, which is anchored to the lock body 510 at 578 (right hand, bottom corner of FIG. 5*a*).

The overall locking mechanism 512 comprises a thumb slider 530, which slides in a slide channel 532, back and forth along the length of the lock body 512. The slider 530 has a slider body 534 which penetrates into the interior of the body 510 and has at its distal end, an angled cam surface 536.

The thumb slider 530 interacts with a lock actuator 550 having a jutting finger 552 at the bottom and a spring well 554 which support therein a first spring 558 which spring biases the thumb slider body 534 to the right in the figure against a stop 559 (which is physically part of the actuator 550). At the center, the actuator 550 has a trapezoidal locking space which receives a wedge 566 of a lock head 564 on which are supported the locking pins 562*a*, 562*b*, for a purpose which will become apparent further on.

FIG. 5*a* shows the unlocked position where the thumb slider 530 is located all the way to the right in the sliding channel 532, with its depending body 534 pushing against the stop 559. This position is attained owing to the first spring 558 pushing on the thumb slider body 534, creating a space 553, and is further attained by the second spring 556 pushing the entire actuator 550 to the right in the figure. In this position, the actuator 550 pulls on the lock head 564 and assures that the locking pins 562*a*, 562*b* are in a retracted position outside the security slot 501*a*.

Figure 5B:
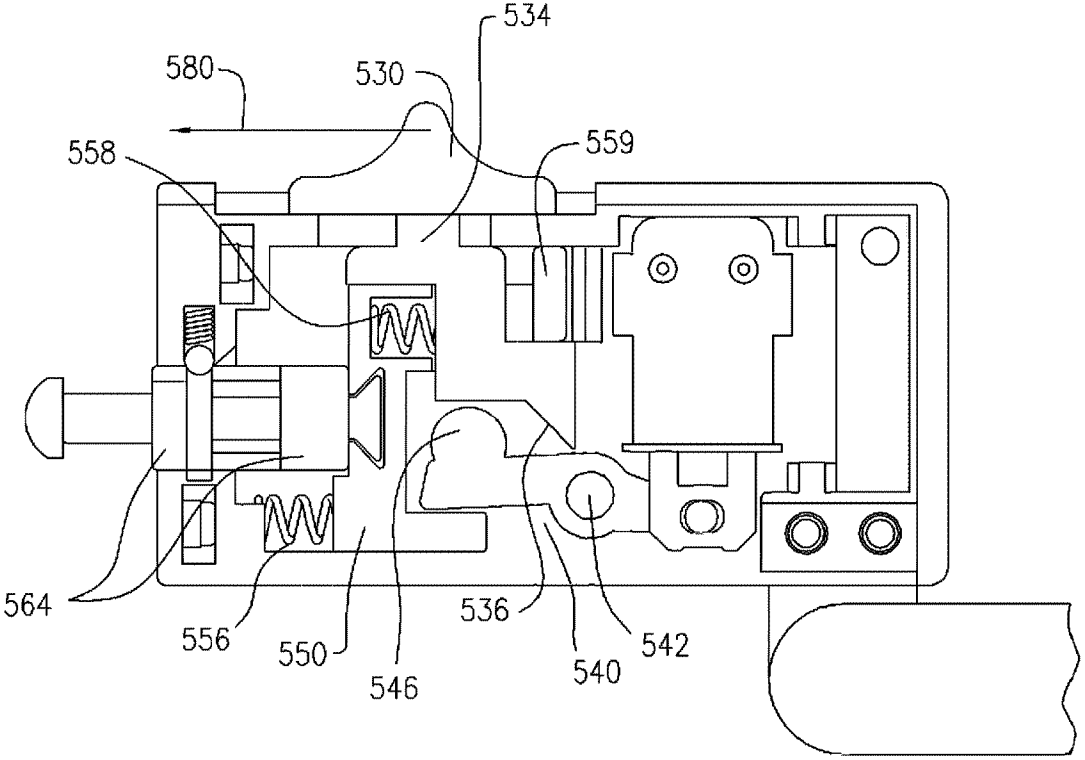
Figure 5C:
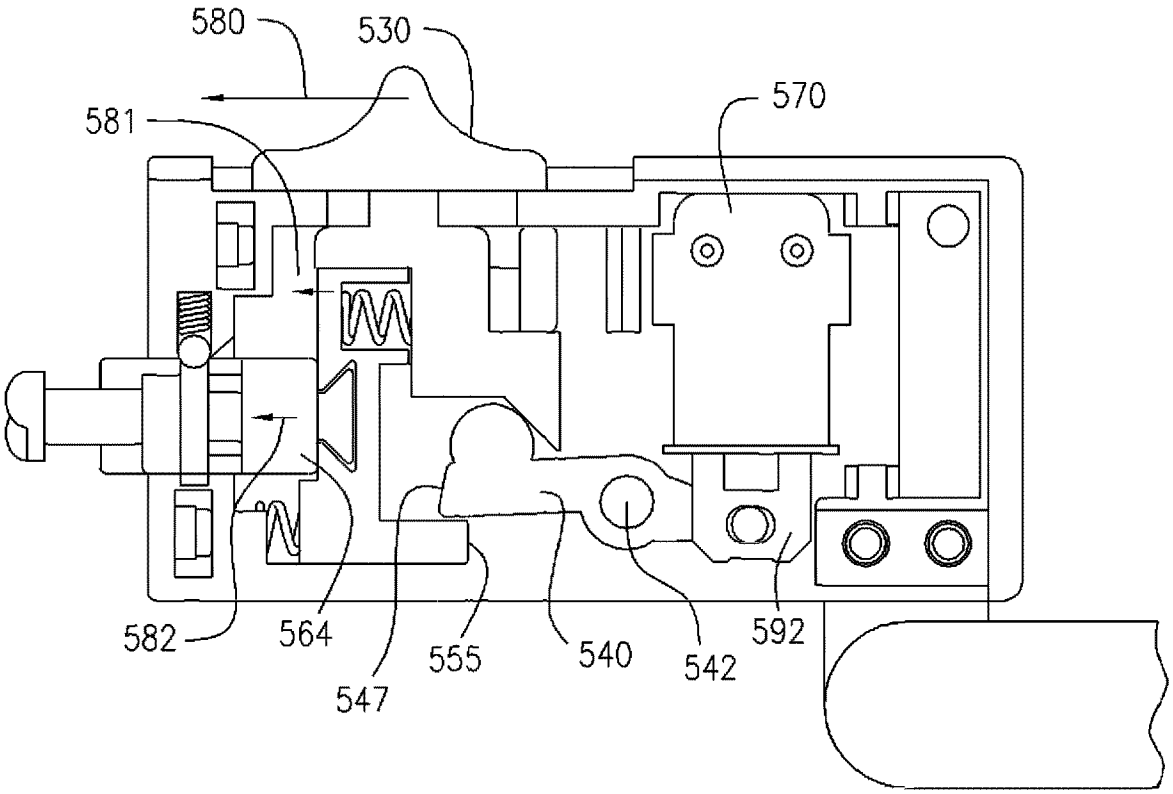

Referring to FIG. 5*b*, when a user applies thumb pressure on the thumb slider 530 in the direction of the arrow 580, the first spring 559 becomes compressed and the slider body 534 moves away from the stop 558 during the initial phase of the sliding movement. As more force is applied, and the slider moves further to the left, its body 534 exerting a force on the entire actuator 550, which begins to compress the second spring 556 and move the lock head 564 to the left. As the sliding movement of the thumb slider continues, the locking pins 560*a*, 560*b* begin to penetrate into the security slot 501*a*, preventing rotation of the lock body relative to the security slot and separation of the lock body from the device that requires protection.

Figure 5D:
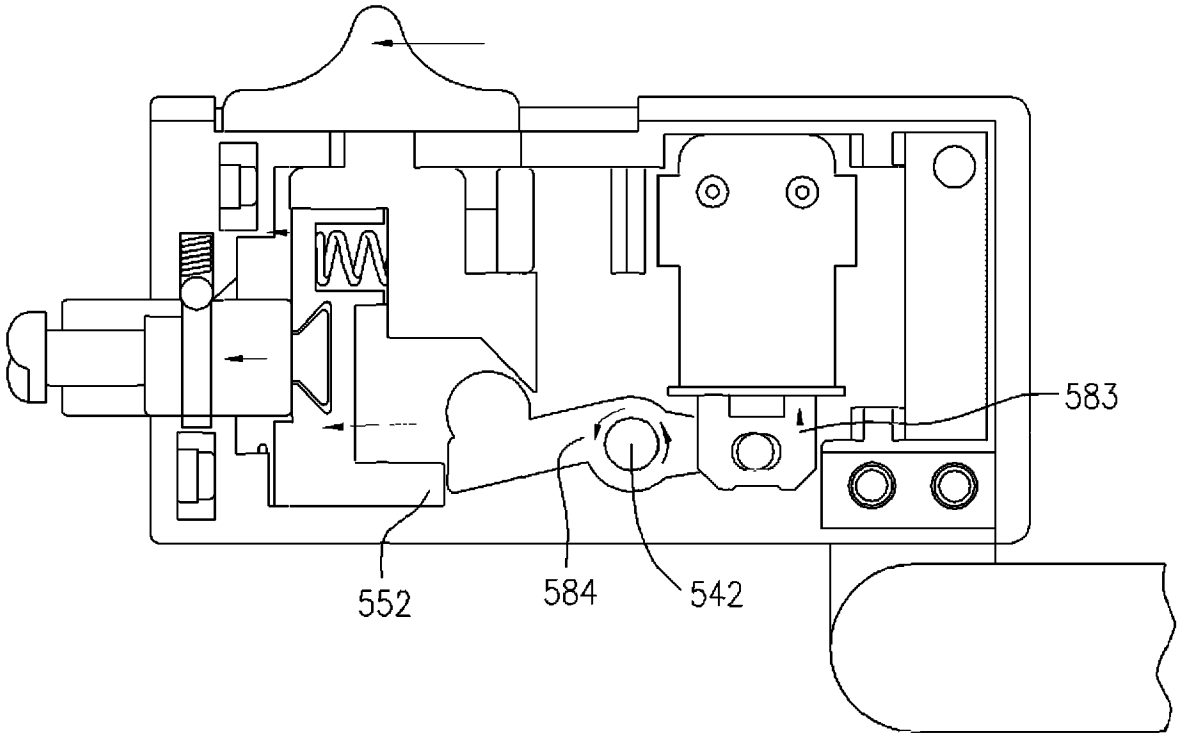

As this sliding motion proceeds, the cam 536 bears against the ball head 546 of the latch 540, which latch is pivoted at 542 (FIG. 5*a*). All the while, the actuator continues to move in the direction of arrow 581 and the lock head in the direction of arrow 582 until eventually, as shown in FIG. 5*d*, the distal end 547 of the latch 540 clears the distal end of the finger 552 and is pushed down, owing to its rotation along the arrow 584 and its being pushed down by cam 536. At this point, the lock body 501 is locked to the device, and owing to the inter-engagement between the surfaces 555, 547, the lock head 564 and the actuator 550 cannot move back to the right. This is the locking position.

At the same time, the counterclockwise rotation of the latch 540 about the pivot 542 causes the plunger 572 of the solenoid 570 which has a slot engaged by the pin 544 of the latch 540 to be pushed inside the solenoid. Thus, the plunger becomes magnetically locked in the solenoid as the plunger 572 moves along the arrow 583, as shown in FIG. 5*d*.

Figure 5E:
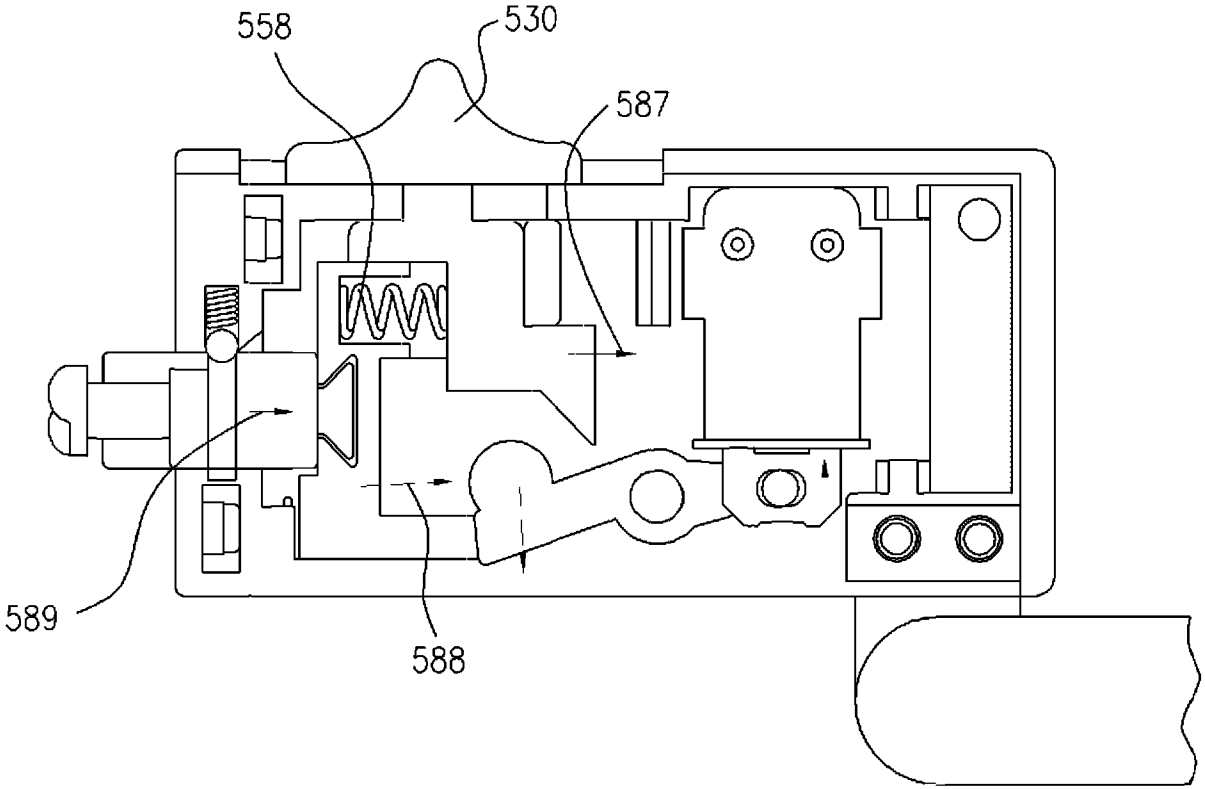
Figure 5F:
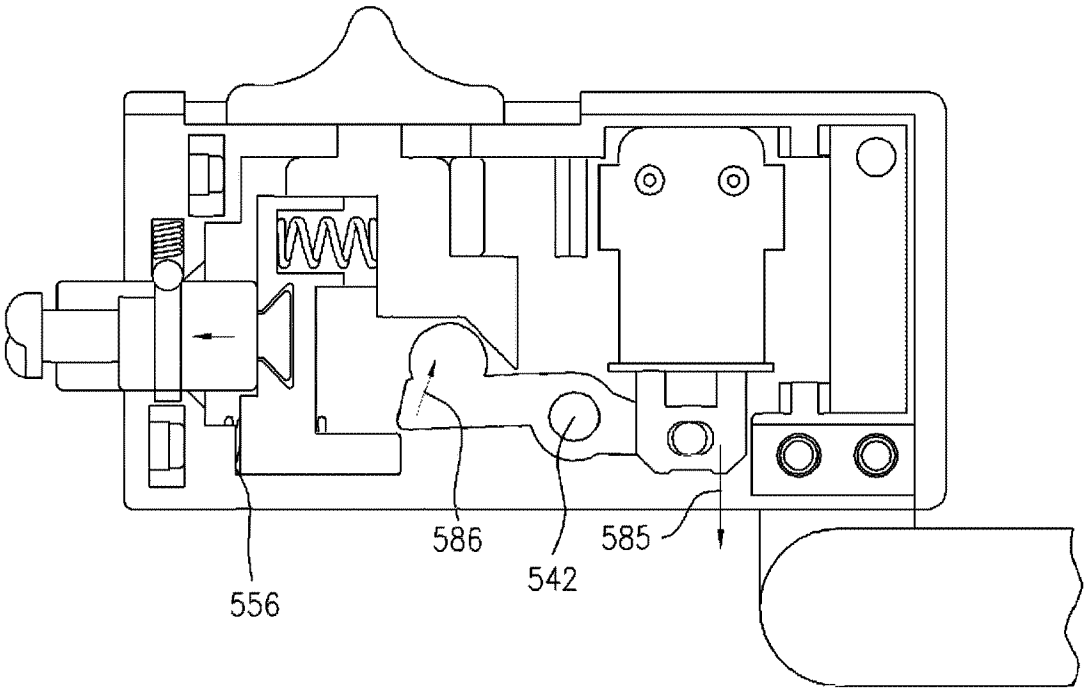
Figure 5G:
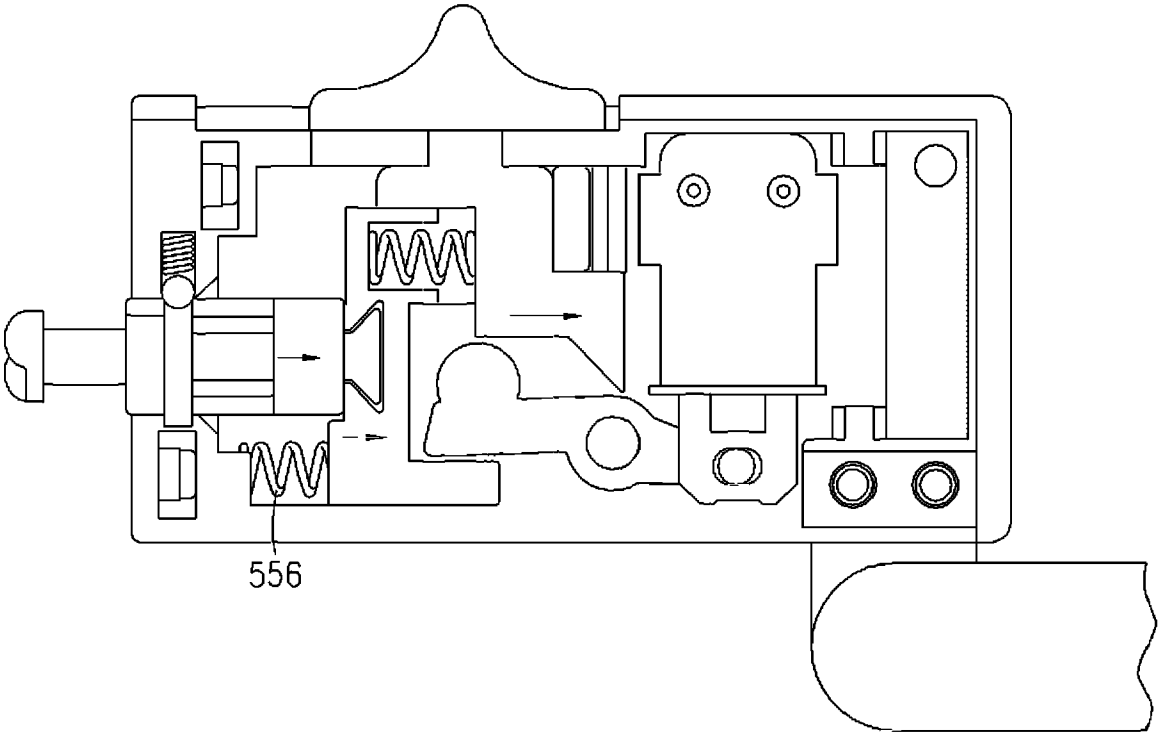

As the user releases the thumb pressure on the thumb slider 530, the slider 530 assumes a center position, as shown in FIG. 5*e*, owing to its movement along the arrow 587 due to the pushing force of the first spring 558 until it comes to rest against the spring 558. This position of the slider 530 is indicative of the lock mechanism 512 being in a locked position. In the locked position, the first spring pushes on the slider body along the arrow 587 and the spring 556 (FIG. 5*b*) exerts a force on the actuator along the arrow 588, which produces a pulling force on the lock head along the arrow 589.

Referring again to FIG. 5*a*, the locking mechanism 512 incorporates an electrical system 520 which can be controlled wirelessly or via a USB port (as previously described) by the mobile device 20 which, when desired, allows the user to initiate an electrical control that pushes out the solenoid plunger 572 down along the arrow 585 (FIG. 5*f*), pivoting the opposing arm in a clockwise direction, as indicated by the arrow 586 about the pivot 542, which instantly enables the second spring 556 to push on the actuator to the right, pulling with it the lock head 564 and its locking pins 562*a*, 562*b*, releasing the lock on the device that requires to be held. Simultaneously, the thumb slider 530 moves all the way to the right, which is indicative of the locking mechanism assuming its unlocked position. In this position, the operator can again repeat the foregoing procedure by utilizing the lock body 510 to lock to another device requiring protection, in well known manner.

Figure 6A:
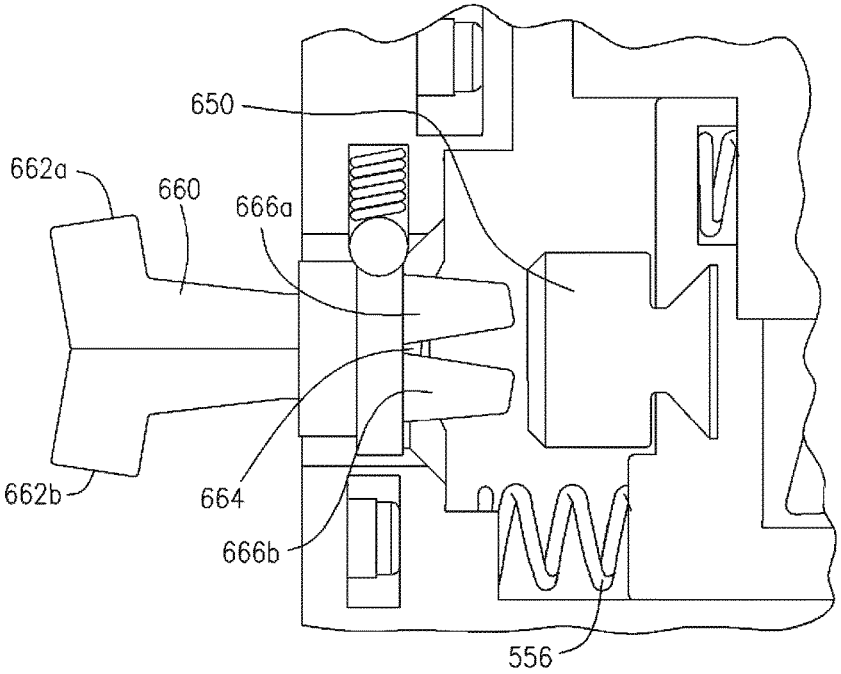
FIGS. 6*a* through 6*c* are diagrams showing an embodiment of the invention with a scissors locking mechanism.
Figure 6B:
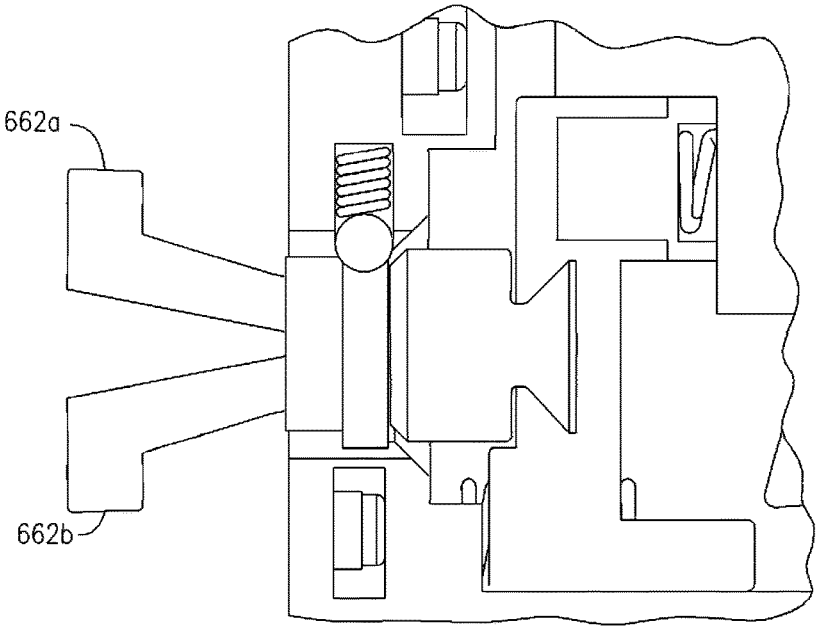
Figure 6C:
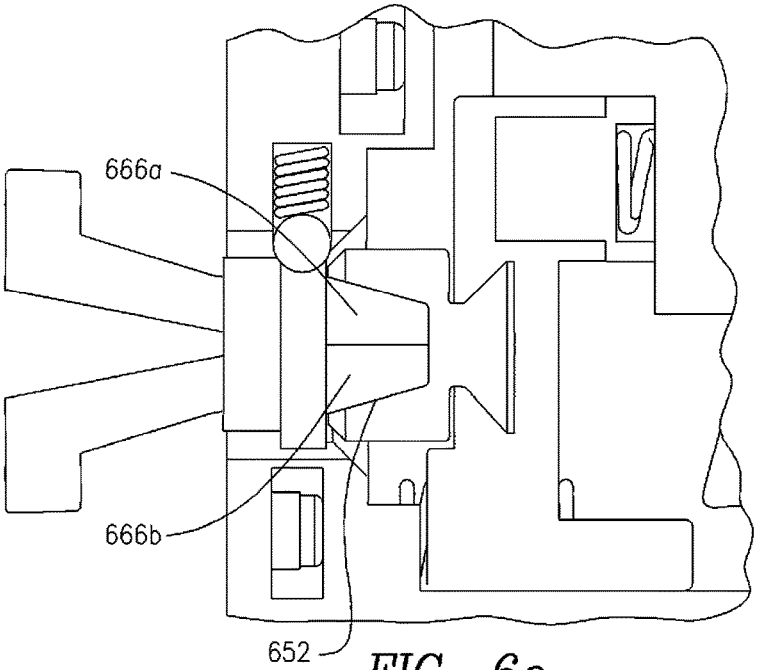

FIGS. 6*a* through 6*c* incorporate, generally, the elements of FIGS. 5*a*-5*g*, but illustrate a variant of the locking head which utilizes a T-bar compatible scissors mechanism using a scissor lock 660 comprising lock arms 662*a*, 662*b*, which are inserted into the rectangular slot 501*a* and then spread apart to obtain the locking function. The locking arms 662*a*, 662*b* pivot about an internal pivot (not shown) and have opposed, corresponding arms 666*a*, 666*b*, which are normally pushed apart by a torsion spring 664, biasing the locking arm 662*a*, 662*b* into an unlocked position.

However, when the lock head 650 is pushed onto the actuating arms 666*a*, 666*b*, they become squeezed together, which produces the locked position shown in FIG. 6*b*. This is accomplished by providing within the lock head actuator a cone-shaped opening 652 (FIG. 6*c*) whereby, when the lock head is pushed onto the arms 666*a*, 666*b*, the arms are squeezed together, as shown.

Figure 7A:
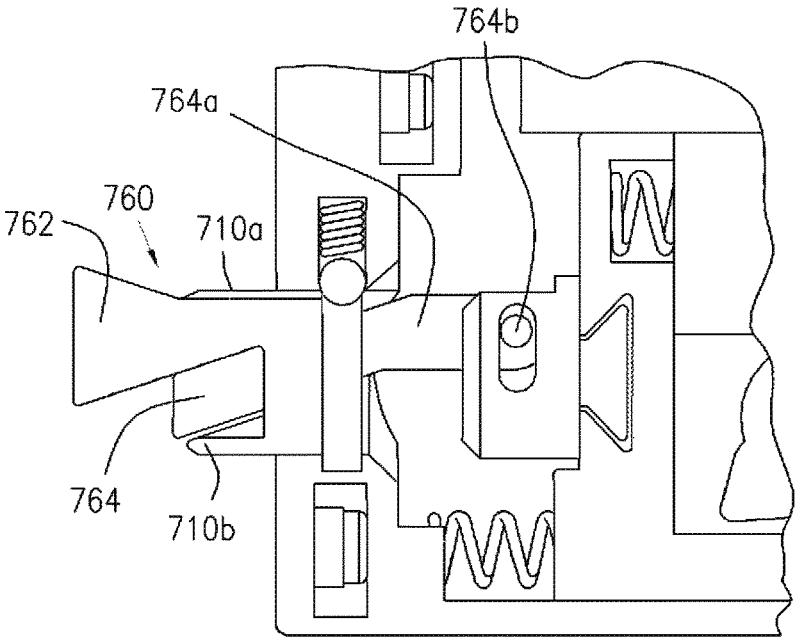
FIGS. 7*a* through 7*c* are diagrams showing an embodiment of the invention with a wedge shaped locking element for locking in a trapezoidal security slot.
Figure 7B:
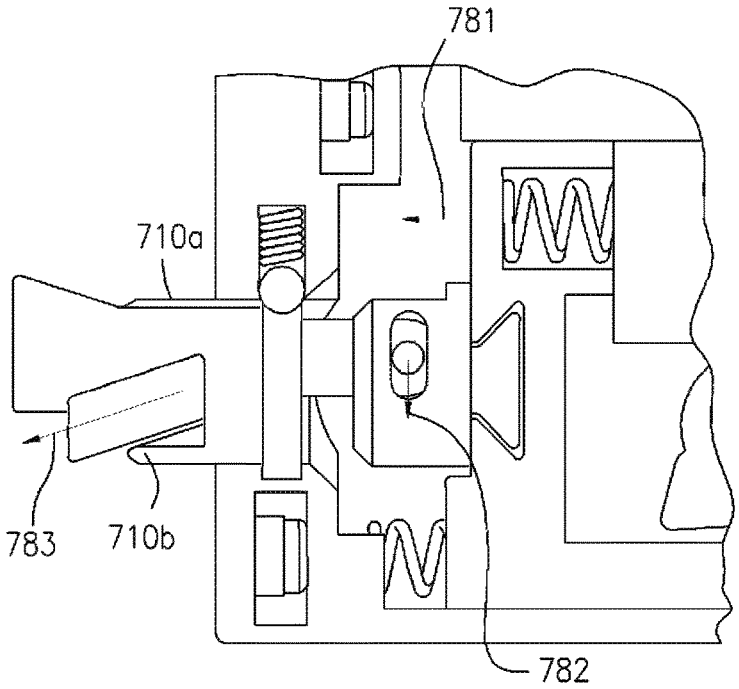
Figure 7C:
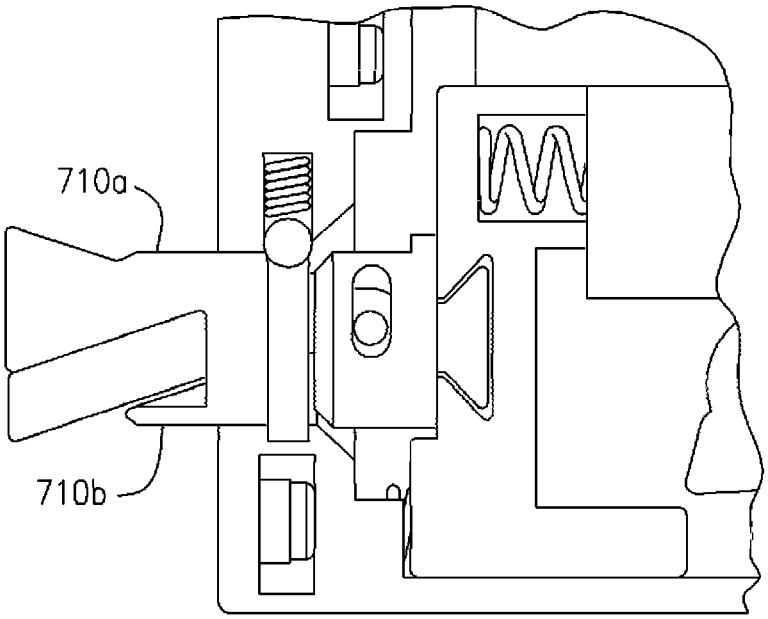

FIGS. 7*a* through 7*c* show a wedge shaped locking element system 760 with a stationary trapezoidal head 762 and an angled lock bar 764, which is constructed to slide out to fill a trapezoidal locking hole, as described in a pending application of the present inventor, to thus provide the locking function. The locking bar 764 extends into a horizontal arm 764*a*, which has pin 764*b* which slides in a vertically extending channel 752 of the actuator 750. Thus, when the actuator is pushed to the left in FIG. 7*a*, it pushes the arm 764*a* to the left and the locking bar 764 along the direction of the arrow 783, as the actuator moves to the left along direction 781, ultimately reaching the position shown in FIG. 7*c*, which is the locked position. This produces the overall wedge shaped locking head which irremovably fits into a trapezoidal hole by fitting on the lock body. The centering bevels 710*a*, 710*b* guide the movement of the locking bar 764 to the locking position.

Figure 8A:
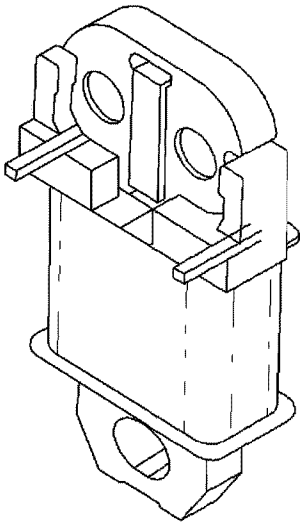
FIG. 8a (Prior Art)
FIG. 8*a* shows a prior art, conventional solenoid.

In the foregoing description, the solenoid 570 can be the solenoid 571 shown in prior art FIG. 8*a* which depicts a Tricore solenoid model no. MG10110, which requires a voltage pulse of about 4.3 VDC and a pulse duration of about 10 milliseconds, but the pulse width can be in the range of 5 to 100 milliseconds. The holding force of the plunger within is approximately 4.9 newtons.

Figure 8B:
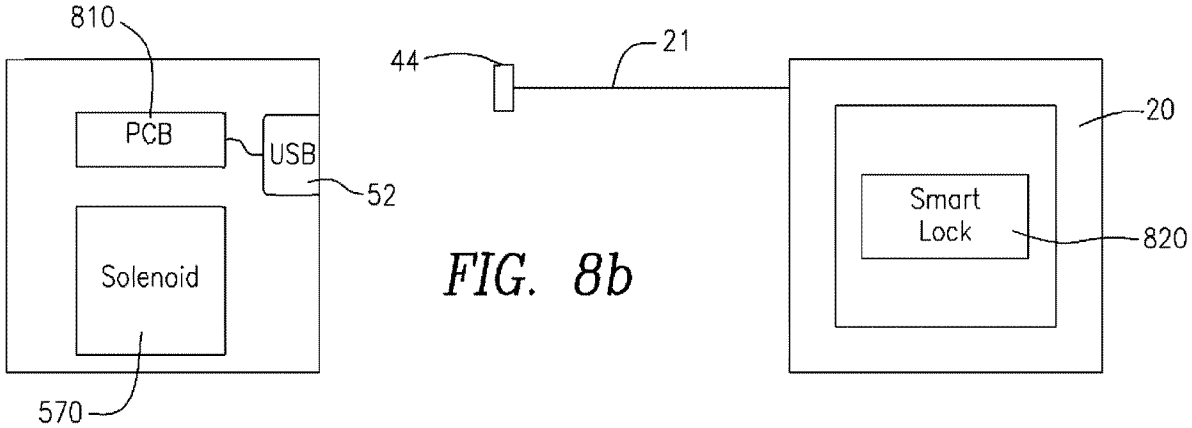
FIG. 8*b* is an embodiment showing the use of the solenoid in FIG. 8*a* in conjunction with a mobile device.

As shown in FIG. 8*b*, the solenoid 570/571 is connected to a PCB 810, which houses thereon various electronics, for example, electronics of the type previously mentioned in reference to FIGS. 2 and 4, which PCB is connected via a connector 52 that can be accessed by a USB connector 44 from the mobile device 20 which runs various APPs, including a smartlock APP 820.

Figure 9:
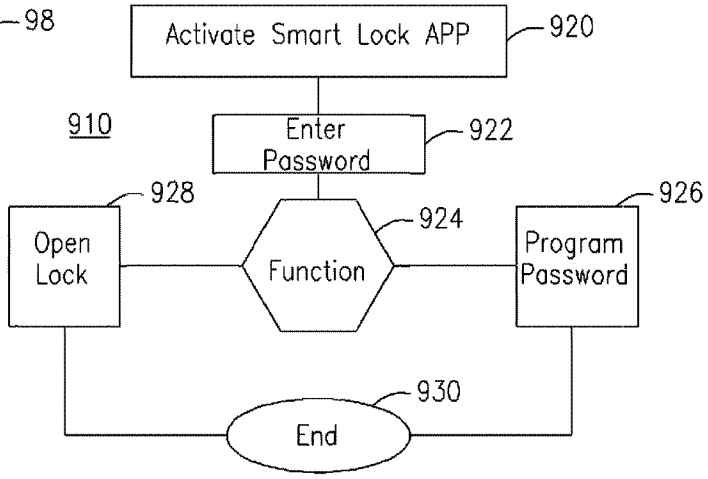
FIG. 9 is a block diagram showing a mobile device APP.

With reference to FIG. 9, a flowchart for the smartlock APP 820 may include therein the software necessary to implement the flow sequence 910 which begins at step 920 with the activation of the APP as, for example, by pressing a particular icon on the mobile device 20. The activation of the smartlock APP 820 requests the user to enter a password at step 922 and, if properly entered, takes the client to the decisional block 992, asking whether the user wishes to program a new password, as indicated at 926, or clicking the icon again to open the lock, as shown at 928, by sending a particular code to a circuit of the type shown in either FIG. 2 or FIG. 4.

In connection with the foregoing, in accordance with one embodiment of the invention, the counter 97 in FIG. 4 is replaced with a controller 58 of FIG. 2, and the mobile device 20 communicates with the controller which houses therein non-volatile memory in which is stored an initial password, revealed to the user when the user purchases the device. However, the flowchart of FIG. 9 allows the user to thereafter change to a password of her choice. Also, the software in the controller 97 can be programmed to run an algorithm that is provided with great security, including a sequence of numbers which constitute a master code for manufacturers of different locks. Once the master code is properly entered, the software allows the setting of a different password or the initial password, bypassing the security.

The electrical circuit within the lock can be powered by a battery or it can be powered through power delivered from the USB port or wirelessly.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A locking system comprising:

a lock body including a locking element, a moving mechanism coupled to and configured to operate the locking element, an electrical controller configured to control the moving mechanism, the lock body further comprising a facility for receiving electrical commands for the electrical controller;

a separate mobile electronic device for providing said electrical commands to direct the electrical controller to at least control the moving mechanism to move the locking element into one of an unlocked position or a locked position, wherein the electrical controller is configured to control the moving mechanism to move to the unlocked position, and including a user operable slider which is configured to be moved to mechanically operate the locking system to move the locking element into the locked position.

2. A locking system comprising:

a lock body including a locking element, a moving mechanism coupled to and configured to operate the locking element, an electrical controller configured to control the moving mechanism, the lock body further comprising a facility for receiving electrical commands for the electrical controller;

a separate mobile electronic device for providing said electrical commands to direct the electrical controller to at least control the moving mechanism to move the locking element into one of an unlocked position or a locked position, wherein the moving mechanism comprises a thumb slider, which is mechanically positioned to push an actuator, which actuator is, in turn, coupled to a lock head and further comprising a latch which is configured to assume a latched position at which the locking element is in the locked position.

3. The locking system of claim 2, wherein the latch is pivotable and comprises an arm that engages a plunger of a solenoid and is configured to push the plunger into the solenoid to be held therein during the locked position.

4. The locking system of claim 3, including a first spring which biases the thumb slider away from the actuator and a second spring which biases the actuator in a direction toward the unlocked position.

5. A locking system for a device or structure requiring locking, comprising:

a lock body including a locking element and said locking body being configured to be physically attached to said device or structure with said locking element penetrating into a portion of said device or structure, a moving mechanism coupled to and configured to operate the locking element, an electrical controller configured to control the moving mechanism, the lock body further comprising a facility for receiving electrical commands for the electrical controller;

a separate mobile cell phone device, physically separated from said device or structure and configured to communicate directly with said electrical controller and to provide to said electrical controller said electrical commands to direct the electrical controller to at least control the moving mechanism to move the locking element into an unlocked position, based solely on said electrical commands from said mobile device, and wherein said lock body comprises a short term electrical power storage device, the storage device being configured to store said electrical power temporarily for a duration sufficient to operate the moving mechanism to move the locking element into the unlocked position, and said short term power storage device being without any connection to an external DC and/or AC power source, and said storage device being configured to receive said electrical power to temporarily power and operate said electrical controller and said moving mechanism solely from said mobile cell phone device.

6. The locking system of claim 5, wherein the mobile device communicates with the controller by being connected thereto through a USB port via a direct connection utilizing at least one physical connector.

7. The locking system of claim 5, wherein the mobile device communicates with the controller wirelessly.

8. The locking system of claim 5, wherein the lock body comprises a capacitor for temporarily powering up the controller for a time duration of less than about two minutes and in an amount sufficient to operate the locking element between locked position to the unlocked position.

9. The locking system of claim 5, wherein the locking element is configured to fit a 3×7 millimeter security slot.

10. The locking system of claim 5, wherein the locking element is configured to lock inside a trapezoidal shape security slot.

11. The locking system of claim 5, wherein the lock body has a cable terminating in a loop attached thereto.

12. The locking system of claim 5, wherein the electrical controller is configured to control the moving mechanism to move to the unlocked position.

13. The locking system of claim 5, wherein the moving mechanism comprises a lock head and the locking element comprises pivotable lock arms and corresponding actuating arms and an actuator that is configured to be pushed onto the actuating arms, pivoting them toward each other in the locked position.

14. The locking system of claim 5, further including a mobile device APP program for operating the moving mechanism by entry of a password, and for altering said password.

15. The locking system of claim 5, including an electrical circuit which is responsive to a voltage pulse.

16. The locking system of claim 15, wherein the voltage pulse is a DC pulse in the range from 5 to 100 milliseconds.

17. The locking system of claim 5, wherein said mobile device is of a size and shape that is configured to be handheld.

18. The locking system of claim 17, wherein said separate mobile cell phone device is configured to electrically power said electrical controller and said moving mechanism via power delivered wirelessly from an AC primary winding.

19. The locking system of claim 17, wherein said electrical power is configured to be stored in a storage capacitor located in said lock body that is capable of holding said electrical power for a duration of at most a few minutes.

20. The locking system of claim 5, wherein said electrical controller is configured to maintain said locking element in said unlocked position for only a set duration which duration is at least one of a preprogrammed duration or a duration that endures for as long as an operator presses a button on said mobile cell phone device.

21. The locking system of claim 5, wherein said lock body comprises a security password and said electrical controller is configured to act on said electrical commands only upon receipt of said security password from said mobile cell phone device.

22. The locking system of claim 5, wherein the device or structure comprises a door of a residence home.

23. The locking system of claim 5, wherein the device or structure comprises a mobile electronic device which is provided separately of and not physically connected to the mobile cell phone device.

* * * * *